US007144667B2

(12) United States Patent
Kawanishi et al.

(10) Patent No.: US 7,144,667 B2
(45) Date of Patent: Dec. 5, 2006

(54) ELECTROSTATIC CHARGE IMAGE DEVELOPING TONER, AND DEVELOPER, IMAGE FORMING APPARATUS AND IMAGE FORMING METHOD USING THE SAME TONER

(75) Inventors: Tsuneaki Kawanishi, Ibaraki (JP); Junji Kobayashi, Ibaraki (JP); Ryuuichi Shimizu, Ibaraki (JP); Shigenori Yaguchi, Ibaraki (JP); Hirobumi Ouchi, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 231 days.

(21) Appl. No.: 10/788,393

(22) Filed: Mar. 1, 2004

(65) Prior Publication Data

US 2004/0175640 A1 Sep. 9, 2004

(30) Foreign Application Priority Data

Mar. 3, 2003 (JP) ..... P. 2003-056153
Nov. 6, 2003 (JP) ..... P. 2003-377066

(51) Int. Cl.
*G03G 9/00* (2006.01)

(52) U.S. Cl. ..... 430/108.8; 430/109.3; 430/111.4; 399/252

(58) Field of Classification Search ..... 430/108.8, 430/109.3, 111.4; 399/252
See application file for complete search history.

(56) References Cited

U.S. PATENT DOCUMENTS 6,783,909 B1 * 8/2004 Kawanishi et al. ..... 430/108.8

FOREIGN PATENT DOCUMENTS

| | | |
|---|---|---|
| JP | 52-3304 | 1/1977 |
| JP | 52-3305 | 1/1977 |
| JP | 57-52574 | 11/1982 |
| JP | 5-313413 | 11/1993 |
| JP | 6-123994 | 5/1994 |
| JP | 6-324513 | 11/1994 |
| JP | 7-36218 | 2/1995 |
| JP | 7-209909 | 8/1995 |
| JP | 7-287413 | 10/1995 |
| JP | 7-287418 | 10/1995 |
| JP | 8-114942 | 5/1996 |
| JP | 8-314181 | 11/1996 |
| JP | 9-179335 | 7/1997 |
| JP | 9-281748 | 10/1997 |
| JP | 9-304966 | 11/1997 |
| JP | 9-319139 | 12/1997 |

* cited by examiner

*Primary Examiner*—Mark A. Chapman
(74) *Attorney, Agent, or Firm*—McGinn IP Law Group, PLLC

(57) ABSTRACT

The invention provides an electrostatic charge image developing toner containing a fixing resin and a wax, characterized in that in a DSC curve measured by a differential scanning calorimeter for the wax, a maximum endothermic peak of endothermic peaks at temperature up is less than 70° C., on-set temperature attributable to the maximum endothermic peak is above 50° C., and lowest on-set temperature of on-set temperatures attributable to endothermic peaks except the maximum endothermic peak is in a range of from 30° C. to 40° C.

19 Claims, 2 Drawing Sheets

ELECTROSTATIC CHARGE IMAGE DEVELOPING TONER, AND DEVELOPER, IMAGE FORMING APPARATUS AND IMAGE FORMING METHOD USING THE SAME TONER

BACKGROUND OF THE INVENTION

1. Field of the Invention

The present invention relates to an electrostatic image developing toner that makes visible an electrostatic latent image formed by electrophotography, electrostatic printing or electrostatic recording, a developer using the toner, an image forming apparatus, and an image forming method.

2. Description of the Related Art

Of the above-mentioned printing or recording methods, for example, the electrophotography involves charging and exposing the photoconductor, creating an electrostatic latent image on the photoconductor, developing the electrostatic latent image with a particulate toner containing a coloring agent having a binder of resin, transferring and fixing the obtained toner image on the recording paper to produce a recorded image.

In such an electrostatic image recording process, the step of developing the electrostatic latent image with the particulate toner and the step of fixing the electrostatic latent image on the recording paper are particularly important. Conventionally, the typical method for developing the toner is the magnetic brush developing method using a two-component system composed of the toner and a magnetic carrier capable of high speed, high image quality development. Also, the method for fixing the toner is typically the heat roller fixing method with high heat efficiency and capable of high speed fixing.

On the other hand, recently, along with the development of information equipment, a laser beam printer using a laser beam for exposure of the photoconductor has been put commercialized in which a recording image is reproduced in dots by a modulation signal upon an instruction from the computer. Particularly in the recent laser beam printers, there is a demand for forming the image at higher quality, whereby the diameter of laser beam is restricted and reduced to have a high dot density of 600 to 1200 dpi (dots/inch). For the purpose of developing the finer electrostatic latent image, the particle size of toner and carrier is smaller, whereby the particulate toner has a volume average particle size of 10 μm or less and the particulate carrier has a weight average particle size of 100 μm or less. These particulate toner and particulate carrier are progressively employed.

On the other hand, the heat roller is often used for fixing. From the viewpoints of suppressing overheat deterioration of the printer and preventing heat deterioration of the cabin parts, shortening the warm-up time for activating the fixing unit to be ready for fixing, preventing a fixing failure due to heat absorbed into the recording sheet to keep the image quality through the continuous paper feed, preventing the recording sheet from being curled or burnt due to over heating, and reducing the load on the heat roller to simplify the structure of the fixing unit and reduce the size, there is a demand for developing the toner that can be fixed with lower power consumption of a fixing roller and a drive motor, using the heat roller at the lower temperatures and lower pressures.

Thus, there is a demand for developing the high performance particulate toner that can be fixed at lower temperatures and lower pressures. On the other hand, when the toner has particle size of 10 μm or less, as previously described, there are following problems. That is, in the developing process, though the high image quality is attained by using the particulate toner, the toner adherence (fogging) to non-image parts and the toner splash are likely to occur, possibly impairing the handling of the toner such as toner conveyance due to lower fluidity.

Moreover, due to strong adherence and weak shock resistance of the particulate toner, the carrier contamination (carrier spent) by the toner is likely to occur, possibly lowering the developer life. In fixing, the particulate toner requires more energy than the toner having large particle size to attain the same fixing strength, and there is a lower yield in the powdering and classification process when manufacturing the toner, so that the cost of the toner is raised.

The particulate toner has many problems as described above. Usually, it is difficult to practically use the toner having an average particle size of less than 3 μm. It is common to classify the average particle size of the toner in a range of from 3 to 10 μm, and increase the fluidity with the improved outside additives or outside treatment for the toner. On the other hand, the carrier has a small particle size of 100 μm or less, the specific surface area of the carrier being increased to improve the frictional electrification with the toner, when the particle size of the toner is smaller. However, the carrier of less than 30 μm has a lower magnetic force, and is more likely to adhere onto an electrostatic image holding member due to an electrostatic suction force. Therefore, the average particle size of the carrier is classified in a range of from 30 to 100 μm. If required, the surface of carrier is coated with resin.

With the better particle grading distribution and the improved fluidity and charging ability, the particulate toner and the developer have been put to practical use on the copying machine and the printer. However, when the printing is performed by the actual machine, especially when the high speed printing at 10 pages or more per minute is repeated, there is a problem peculiar to the particulate toner, in which the developer life is shortened by a carrier spent with the toner, and the photoconductor life is shortened by a photoconductor filming with the toner. The fixing strength of image is difficult to attain, and it is necessary to increase the temperature and pressure of the heat roller, especially in the fixing process. Thus, there was a problem that it was difficult for the fixing unit to achieve higher reliability, simplification and miniaturization, and cost reduction.

To enhance the fixing performance of the toner, it is well known to add a wax to the fixing resin. For example, several techniques were disclosed in JP-B-52-3304, JP-B-52-3305 And JP-B-57-52574.

Waxes are employed to prevent the toner from adhering to the heat roller when the toner has lower temperatures or higher temperatures, namely, a so-called offset phenomenon, and enhance the fixing property of the toner at lower temperatures. Recently, a low melting point wax has gained attention from the viewpoint of low temperature fixing.

For example, in JP-A-5-313413, it was disclosed that ethylene or propylene having a viscosity of 10000 poise or less at 140° C. and α-olefin copolymer were added to vinyl copolymer having a specific molecular weight distribution to improve the toner in terms of the fixing property at lower temperatures, offset resistance, and non-condensable property.

For the same purpose, JP-A-7-287413 disclosed that the paraffin wax having an absorbed heat quantity peak (melting point) at 75 to 85° C. measured by the differential scanning calorimeter (DSC) was added. Further, JP-A-8-314181, JP-A-9-179335 and JP-A-9-319139 disclosed that the natural gas Fischer-Tropsch wax having a melting point of 85 to 100° C. measured by the DSC was added, JP-A-6-324513 disclosed that polyethylene wax having a melting point of from 85 to 110° C. measured by the DSC was added, JP-A-7-36218 disclosed that polyethylene wax having a melting point of from 70 to 120° C. measured by the DSC from which components having a melting point of 50° C. or less were removed by distillation was added, and JP-A-8-114942 disclosed that polyethylene wax having a weight average molecular weight (Mw) of less than 1000 was added.

On the other hand, if a low melting point wax is added to the toner, the toner is degraded in the heat resistance, durability, preservation stability and fluidity. To improve them, JP-A-6-123994 disclosed that the wax having a weight average molecular weight (Mw)/a number average molecular weight (Mn) of 1.5 or less was used, JP-A-7-209909 disclosed that ethylene olefin copolymer wax having a melt viscosity of 0.5 to 10 mPa·s at 140° C., and a penetration of 3.0 dmm or less was used, and JP-A-7-287418 disclosed that Fischer-Tropsch wax having an average molecular weight of 1000 or more was used.

It is possible to enhance the fixing performance of toner by using these conventional techniques. However, when the low melting point wax is used, it is difficult to enhance the fixing performance of toner while keeping the heat resistance, durability, preservation stability and fluidity for the toner, especially with the particulate toner. Thus, the toner and the image forming method capable of being practically employed could not be provided.

SUMMARY OF THE INVENTION

It is an object of the invention to provide a particulate toner and a developer, an image forming apparatus and an image forming method, in which the heat resistance, durability, preservation stability and fluidity of the toner are excellent, the toner concentration is less likely to change due to a lower developer life caused by a carrier spent with the toner, a lower photoconductor life caused by a photosensitive filming with the toner, and a lower fluidity of the toner caused under the environment, with a small energy required for fixing, the temperature and pressure of the heat roller can be lowered by using a heat roller fixing method, and an offset phenomenon is less likely to occur, and an image forming method and an image forming apparatus capable of forming the electrostatic toner image stably, using the particulate toner and the developer.

The present invention has been achieved to solve the above-mentioned problems, and provides, as first aspect of the invention, an electrostatic charge image developing toner containing at least a fixing resin and a wax, characterized in that in a DSC curve measured by a differential scanning calorimeter for the wax, maximum endothermic peak of endothermic peaks at temperature up is less than 70° C., on-set temperature attributable to the maximum endothermic peak is above 50° C., and lowest on-set temperature of on-set temperatures attributable to other endothermic peaks except the maximum endothermic peak is in a range of from 30° C. to 40° C.

The invention provides, as a second aspect of the invention, the electrostatic charge image developing toner according to the first aspect of the invention, characterized in that the wax is hydrocarbon wax containing no branching carbon measured by 13C-NMR.

The invention provides, as a third aspect of the invention, the electrostatic charge image developing toner according to the first or second aspect of the invention, characterized in that the wax is composed of A and B as follows.

Where A is a wax in which weight average molecular weight (Mw)/number average molecular weight (Mn) is more than 1.5, melt viscosity at 140° C. is less than 10 mPa·s, and the crystallinity is less than 90%, and B is a wax in which weight average molecular weight (Mw)/number average molecular weight (Mn) is 1.5 or less, melt viscosity at 140° C. is less than 10 mPa·s, and crystallinity is 90% or more.

The invention provides, as a fourth aspect of the invention, the electrostatic charge image developing toner according to the third aspect of the invention, characterized in that for the wax A, the weight average molecular weight (Mw)/number average molecular weight (Mn) is from 1.5 to 10, melt viscosity at 140° C. is from 1 to 10 mPa·s, and crystallinity is from 70 to 90%, and for the wax B, weight average molecular weight (Mw)/number average molecular weight (Mn) is from 0.5 to 1.5, melt viscosity at 140° C. is from 1 to 10 mPa·s, and crystallinity is from 90 to 100%.

The invention provides, as a fifth aspect of the invention, the electrostatic charge image developing toner according to the third or fourth aspect of the invention, characterized in that the wax mainly includes the wax B.

The invention provides, as a sixth aspect of the invention, the electrostatic charge image developing toner according to any one of the first to fifth aspect of the invention, characterized in that the fixing resin is vinyl copolymer, and contains a copolymer polymerized under existence of the wax.

The invention provides, as a seventh aspect of the invention, the electrostatic charge image developing toner according to any one of the first to sixth aspect of the invention, characterized in that melting start temperature (Tfb) of the toner has a relation Tmp<Tfb<110° C. for melting point (Tmp) corresponding to the maximum endothermic peak attributed to the wax in an absorbed heat quantity curve at temperature up in a DSC curve of the toner measured by a differential scanning calorimeter, and glass transition point (Tg) of toner is above 50° C.

The invention provides, as a eighth aspect of the invention, the electrostatic charge image developing toner according to any one of the first to seventh aspect of the invention, characterized in that when storage temperature of the toner is changed from 45° C. to 50° C., a decrease ratio in fluidity of the toner is less than 7%.

The invention has the above constitution, and provides a toner that is excellent in heat resistance, durability, preservation stability, and fluidity, and takes a lower energy for fixing, a developer, a reliable image forming apparatus and an image forming method using the toner and the developer.

DETAILED DESCRIPTION OF THE PREFFERED EMBODIMENTS

Figure 1:
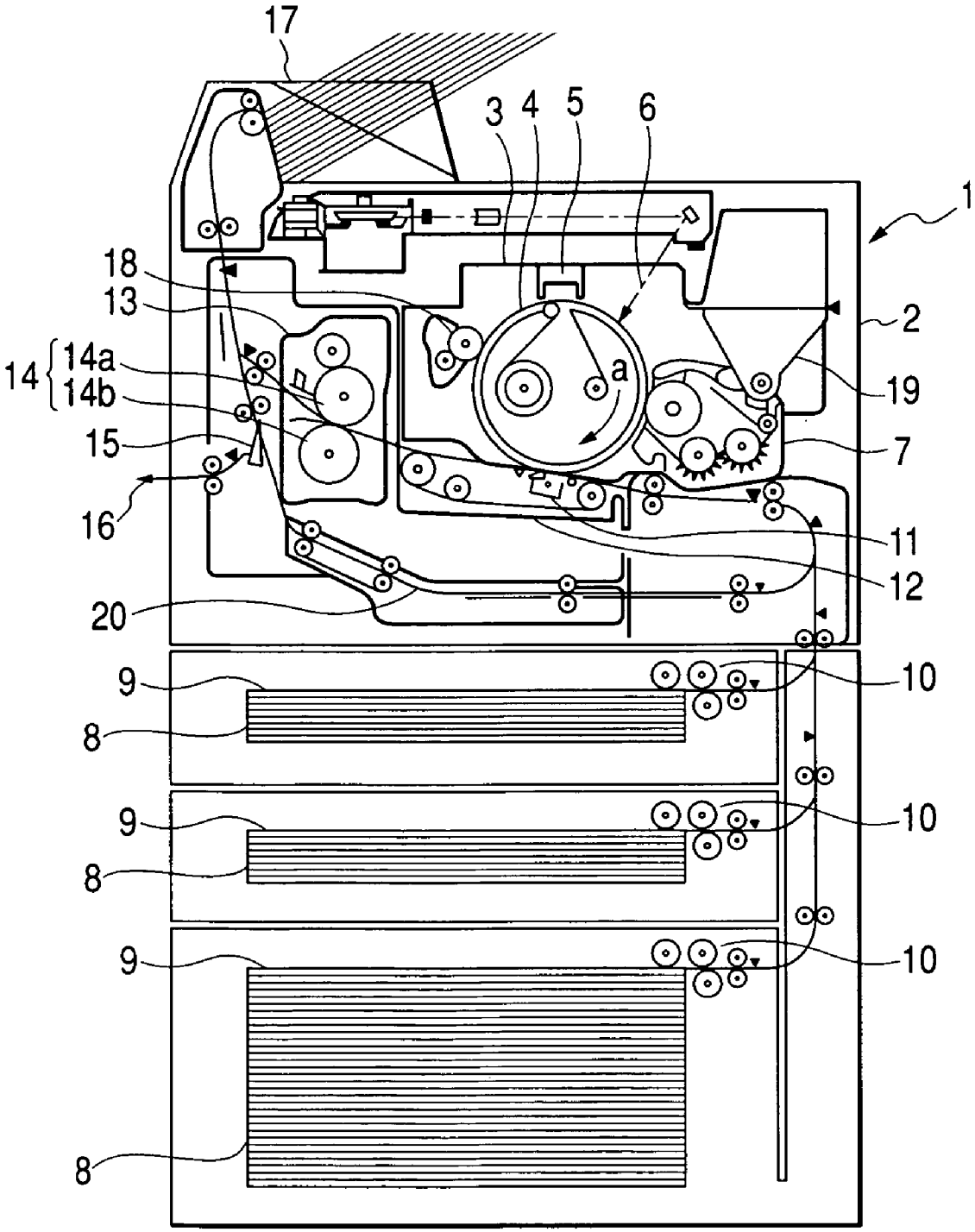
FIG. 1 is a schematic view of a laser beam printer according to the present invention.

The preferred embodiments of the present invention will be described below in detail.

Typically, as the toner fixing resin, a vinyl copolymer, or particularly, a styrene or (metha)acrylic resin, is used for the heat roller fixing, and recently a polyester resin is used.

However, since a polyester resin typically has a polar group (hydroxyl group, carboxyl group) with high water absorption power, the toner is likely to absorb moisture to cause the charging characteristics to be changed. Therefore, a styrene or (metha)acrylic resin is a main stream for the toner resin. Waxes may be added to this fixing resin to enhance the toner fixing performance.

The waxes were conventionally used as a toner offset inhibitor, but had a problem that they degrades the toner in the heat resistance, durability, preservation stability and fluidity and are likely to cause fusion. There are a variety of kinds of waxes that are properly used according to the function, but from the aspect of toner offset prevention, a hydrocarbon wax that is non-polar and not adherent to the heat roller is optimal.

A hydrocarbon wax is an aggregate of polyolefine molecules having a molecular weight distribution, with its characteristics greatly dependent on the molecular weight distribution. Generally, the hydrocarbon wax is advantageous in the respects of, in addition to preventing the high temperature offset, preventing the low temperature offset by increasing low molecular weight components, and improving the low temperature fixing in which the control temperature of the heat roller is 180° C. or less, namely, from 150 to 180° C.

However, if the low molecular weight components are increased to improve the fixing performance, the heat resistance, durability and preservation stability of the toner are lowered, and the fusion of developer to the carrier and photoconductor is more likely to occur. Therefore, an attempt for making the molecular weight distribution sharp by thoroughly cutting the low molecular weight components of existent hydrocarbon waxes has been made. That is, JP-A-6-123994 disclosed that the molecular weight distribution of wax, which can be measured by gel permeation chromatography (GPC), is made sharp so that the weight average molecular weight (Mw)/a number average molecular weight (Mn) may be 1.5 or less, or preferably 1.45 or less.

However, according to the examinations by inventors of the present invention, it has been revealed that though the heat resistance, durability and preservation stability of the toner are increased by making the molecular weight distribution of the hydrocarbon wax sharp, the fixing performance is insufficient, and degraded when the high speed printing is repeated in A4 longitudinal size at 10 pages or more per minute, especially with the particulate toner.

Thus, the inventors have elaborately evaluated the influence of the molecular weight distribution, melt viscosity, crystallinity, molecular structure, and the DSC curve measured by the differential scanning calorimeter for hydrocarbon waxes on the toner characteristics. As a result of examination of the optimal wax to be added to the toner, it has been found that the constituents of wax should comprise of the following waxes A and B.

A wax: weight average molecular weight (Mw)/number average molecular weight (Mn) is more than 1.5, melt viscosity at 140° C. is less than 10 mPa·s, and crystallinity is less than 90%.

B wax: weight average molecular weight (Mw)/number average molecular weight (Mn) is 1.5 or less, melt viscosity at 140° C. is less than 10 mPa·s, and crystallinity is 90% or more.

A mixture of these waxes is hydrocarbon wax containing no branching carbon measured by 13C-NMR. In the DSC curve measured by a differential scanning calorimeter, if maximum endothermic peak of endothermic peaks when increasing temperature is less than 70° C., on-set temperature attributable to the maximum endothermic peak is beyond 50° C., the lowest on-set temperature of on-set temperatures attributable to other endothermic peaks is in a range of from 30° C. to 40° C., the toner fixing performance is greatly improved, in which heat resistance, durability, preservation stability and fluidity of the toner are excellent, and the toner concentration is less likely to change due to a shorter developer life caused by a carrier spent with the toner, a shorter photoconductor life caused by a photoconductor filming with the toner, and a lower fluidity of the toner caused under the environment, whereby the electrostatic toner image is produced stably.

According to this invention, to obtain the sufficient fixing and offset proof properties, it is required that the melt viscosity of wax at 140° C. is less than 10 mPa·s. In such low viscosity waxes, the molecular weight distribution and crystallinity of wax are correlated to some extent. That is, as the molecular weight distribution of wax is larger, the crystallinity is smaller, or as the molecular weight distribution of wax is smaller, the crystallinity is larger. The wax having a large molecular weight distribution is effective to increase the toner fixing performance, but tends to be poor in the durability. The wax having a small molecular weight distribution is effective to increase the durability of the toner, but tends to be poor in the fixing performance.

In this invention, the wax A belongs to the former and the wax B belongs to the latter.

Hydrocarbon wax containing no branching carbon measured by 13C-NMR is produced by combining those waxes appropriately. In the DSC curve measured by the differential scanning calorimeter, if the maximum endothermic peak of the endothermic peaks when increasing temperature is less than 70° C., the on-set temperature attributable to the maximum endothermic peak is beyond 50° C., the lowest on-set temperature of the on-set temperatures attributable to other endothermic peaks is in a range of from 30° C. to 40° C., the toner fixing performance is fully obtained in which the heat resistance, durability, preservation stability and fluidity of the toner are excellent.

According to this invention, the molecular structure of wax suitably contains no branching carbon measured by 13C-NMR. With this molecular structure, the compatibility with a fixing resin can be made reasonable to form an adequate wax domain in the toner, and improve the fixing performance of the toner.

The DSC curve of single wax or a mixture of waxes measured by the differential scanning calorimeter is particularly important. If the maximum endothermic peak of the endothermic peaks when increasing temperature is less than 70° C. in the DSC curve, the low temperature fixing property of toner is improved. On the other hand, if the on-set temperature attributable to the maximum endothermic peak is beyond 50° C., a lower fluidity of the toner caused under the environment and a change in the toner concentration are prevented. Moreover, if the lowest on-set temperature of the on-set temperatures attributable to other endothermic peaks is in a range of from 30° C. to 40° C., the toner fixing performance at low temperatures is improved.

According to this invention, hydrocarbon wax with low viscosity is employed in which the melt viscosity at 140° C. is less than 10 mPa·s. In the case where a large amount of such hydrocarbon wax with low viscosity is added to a toner to increase the fixing strength, the heat resistance, durability, preservation stability and fluidity of the toner are likely to be degraded, unless the dispensability of the wax into the toner is enhanced. A method for improving the dispensability of the wax into the toner is that increasing the energy in thermally melting and kneading the toner to finely disperse the wax into the fixing resin. With this method, however, though the dispensability of a wax is improved, a fixing resin is subject to mechanical damages, thereby bringing about a bad effect of degrading the fixing property or high temperature offset proof property.

Another method for improving dispensability of wax is coexistent polymerization in which wax is coexistent in a part or all of the process for synthesizing the fixing resin, as disclosed in JP-A-5-313413, JP-A-9-281748 and JP-A-9-304966. As a result of examining this method in this invention, the wax could be uniformly dispersed into the fixing resin without deterioration of the resin.

When the resin produced by the coexistent polymerization was applied to the toner, the toner was not degraded in the heat resistance, durability, preservation stability and fluidity of the toner even though a relatively large amount of wax was added. Thereby, it was less likely to occur that the developer life was shortened by a carrier spent with the toner, or the photoconductor life was shortened by a photoconductor filming with the toner. Consequently, the stable electrostatic toner image was created.

Regarding the melting properties of the toner produced by employing the fixing resin and the wax of the invention, the melting start temperature (Tfb) of the toner has a relation Tmp<Tfb<110° C. in the DSC curve of the toner measured by a differential scanning calorimeter, where Tmp is the melting point corresponding to the maximum value of the endothermic peaks attributed to the wax in the absorbed heat quantity curve at temperature up. When the glass transition point (Tg) of the toner is beyond 50° C., the wax performance of the invention is exhibited to the maximum, whereby the toner excellent in the fixing performance, heat resistance, durability, preservation stability and fluidity is obtained.

In this invention, to improve the fixing performance, the melting point (Tmp) corresponding to the maximum value of endothermic peaks attributed to the wax in the absorbed heat quantity curve at temperature up is lower than the melting start temperature (Tfb) of the toner in the DSC curve of the toner measured by a differential scanning calorimeter, whereby the wax is fused before the toner starts to be molten in the fixing process, increasing the release effect of the toner to the fixing roller to prevent the offset and increasing the fixing strength at the same time. The glass transition point (Tg) of the toner is set above 50° C. to secure the preservation stability of the toner. As a result, though the fixing property of the toner is excellent, a shorter developer life caused by a carrier spent with the toner, and a shorter photoconductor life caused by a photoconductor filming with the toner are less likely to occur, whereby the stable electrostatic toner image is created.

In this invention, to attain the heat resistance and durability of the toner, it is required that the endothermic characteristics of wax are reasonable. For the endothermic characteristics of wax and the fluidity of toner, the correlation between changes in the endothermic characteristics and deterioration in the image quality has been examined. As a result, it has been found that temperature changes in the endothermic characteristics of wax and the fluidity of toner are deeply correlated with the deterioration in the image quality caused under the environment. In the absorbed heat quantity curve at temperature up for the DSC curve of wax measured by a differential scanning calorimeter, if the maximum endothermic peak of the endothermic peaks at temperature up is below 70° C., the on-set temperature attributable to the maximum endothermic peak is above 50° C., and the lowest on-set temperature of the on-set temperatures attributable to other endothermic peaks is in a range of from 30° C. to 40° C., a decrease ratio in the fluidity can be less than 7% when the storage temperature of toner is changed from 45° C. to 50° C., whereby it is less likely to occur that the toner causes a deterioration in the image quality under the environment.

In this invention, the toner is mixed with the carrier, the prepared developer is supplied to the laser printer, and a change in the image quality by environment is evaluated. At this time, a mixture ratio of toner and carrier, or a so-called toner concentration, are changed by environment to deteriorate image quality. This is because the fluidity of toner is changed under the environment, and decreased especially at high temperature and high humidity (32° C., 80% RH), whereby the toner is likely to part from the carrier, and judged to be insufficient by a toner concentration control device using a magnetic sensor, so that the toner is refilled excessively, deteriorating the image quality due to excess toner developed.

The fluidity of toner can be measured by a powder characteristics measuring apparatus (Powder Tester PT-R type, made by Hosokawa Micron) using a vibrating screen. That is, the toner is supplied to the vibrating screen of the powder tester, and the amount of toner dropping for a fixed period of time is measured under fixed vibrating conditions, whereby the fluidity of toner is evaluated based on whether the drop amount of toner is large or not. Accordingly, if the drop amount is greater, it is determined that the toner has excellent fluidity.

In this invention, a stainless wire-netting having an inner diameter of 75 mm is employed for the vibrating screen, in which the wire-netting has a wire diameter of 50 μm and a sieve opening of 75 μm. Toner of 5 g is supplied to the vibrating screen, and vibrated for one minute under the conditions where the amplitude is 0.35 mm and the frequency is 50 Hz, thereby measuring the drop amount. A temperature change in the fluidity of the toner was measured by sealing toner of 5 g into a wide mouthed bottle made of synthetic resin, preserving the bottle in a constant temperature bath set up at a test temperature for one hour, and then measuring a drop amount of toner in the same way as above.

In this invention, temperature change in fluidity was measured by changing the temperature of atmosphere around the constant temperature bath for preserving the toner in a range of from room temperatures (about 20° C.) to 60° C. However, the toner of the invention has a change in the fluidity in this temperature range. Particularly, there is a large change at temperatures of 45° C. or higher, and for the toner having a greatly lower fluidity from 45° C. to 50° C., image quality is greatly deteriorated at high temperature and humidity (32° C., 80% RH). If the toner has a decrease ratio of fluidity of less than 7% in this temperature change, it has been found that the image quality is deteriorated in a permissible range at high temperature and humidity. Herein, the decrease ratio of fluidity is defined by the following expression.

Decrease ratio of fluidity (%)=[(drop amount at 45° C.−drop amount at 50° C.)/drop amount at 45° C.]×100

On the other hand, under an environmental test of the printer of the invention, the temperature of a developing machine that conveys and supplies the toner may be 45° C. or higher under the environment of high temperature and humidity (32° C., 80% RH), whereby the wax appearing on the surface of the toner is possibly softened by absorbing the heat to lower the fluidity of the toner. The same phenomenon arises as a decreased drop amount for the toner stored in a constant temperature bath in the temperature changes from 45° C. to 50° C., whereby the stability of the toner in the environment can be evaluated from the value of the decrease ratio.

In this invention, a molecular weight distribution of hydrocarbon wax is measured through a gel permeation chromatography (GPC) at high temperatures under the following conditions.

(GPC Measurement Conditions)

Measuring Apparatus: ALC/GPC 150-C Plus Type (Made by Waters)

Column: GMH6-HT 30 cm×2, GMH6-HTL 30 cm×2 (made by Toso)

Column temperature: 140° C.

Mobile phase: o-dichlorobenzene

Detector: differential refractometer

Flow rate: 1.0 ml/min

Sample concentration: 0.2 wt %

Injection amount: 200 μl

Under the above conditions, a molecular weight of a sample is measured and calculated in terms of polyethylene in accordance with a Mark-Houwink-Sakurada expression or a conversion expression derived from a viscosity expression, employing a molecular weight calibration curve created by a mono-disperse polystyrene standard sample.

A molecular weight distribution of a fixing resin is measured by GPC under the following conditions.

(GPC Measurement Conditions)

Measuring apparatus: HLC-8120GPC (made by Toso)

Column: TSKgel Super HM-H/H4000/H3000/H2000

Column size: 6.0 mmI.D.×150 mm

Column temperature: 40° C.

Eluate: tetrahydrofuran (THF)

Pressure: 13.6 MPa

Detector: differential refractometer

Flow rate: 0.6 ml/min

Sample concentration: 3 g/l THF

Injection amount: 20 μl

Under the above conditions, a molecular weight of sample is measured and a molecular weight and a molecular weight distribution for a entire resin are calculated, employing a molecular weight calibration curve created by a mono-disperse polystyrene standard sample.

In this invention, the melt viscosity of wax is measured at 140° C., employing a Brucke-Field type viscometer. Crystallinity of wax is measured by an X-ray diffraction method under the following conditions.

X-ray: Cu—Kα ray (monochromatic by a graphite monochrome meter), wavelength λ=1.5406 angstrom, output 40 kV, 40 mA Optical system: reflection method, slit DS, SS=1°, RS=0.3 mm Measurement range: 2θ=10° to 35°

Step interval: 0.02°

Scanning speed: 2θ/θ continuous scan 1.00°/minute

Under the above conditions, crystallinity is measured, and an X-ray refraction profile of sample is separated into three crystalline peaks and noncrystalline scattering, and crystallinity is calculated from their areas in accordance with the following expression.

Crystallinity (%)=Ic/(Ic+Ia)×100

Ic: sum of each crystalline peak area

Ia: sum of each crystalline peak area+area of noncrystalline scattering

In this invention, the existence of branching carbon in wax is found, employing 13C-NMR, by observing the peak of methyl group (CH) derived from the branching structure under the following conditions.

Observation frequency: 100 MHz

Pulse mode: proton decoupling method

Pulse width: 4 μs (45 degrees)

Pulse interval: 25 seconds

Sample pipe outside diameter: 5 mm

Measuring solvent: 1,2,4-trichrolobenzene/heavy benzene mixture solution

Sample concentration: 20 w/v %

Measurement temperature: 130° C.

Cumulative number: 1024 times

The peaks of methyl group (CH) are measured under the above conditions. When no peaks are observed, the branching carbon does not exist, whereby the wax having no branching structure is determined.

In a DSC measurement, a heat exchange of wax is measured, and its behavior is observed, whereby a differential scanning calorimeter of heat flux type with ultrahigh sensitivity is preferably employed. For example, 2910 made by TA instruments is usable. The measurement conditions involve laying about 5 mg of wax on the DSC, blowing nitrogen gas at 50 ml per minute, increasing the temperature from room temperatures (about 20° C.) to 220° C. at a rate of 10° C. per minute, decreasing the temperature from 220° C. to room temperatures (about 20° C.) at a rate of 10° C. per minute, taking away the previous history, and increasing the temperature at a rate of 10° C. per minute.

Figure 2:
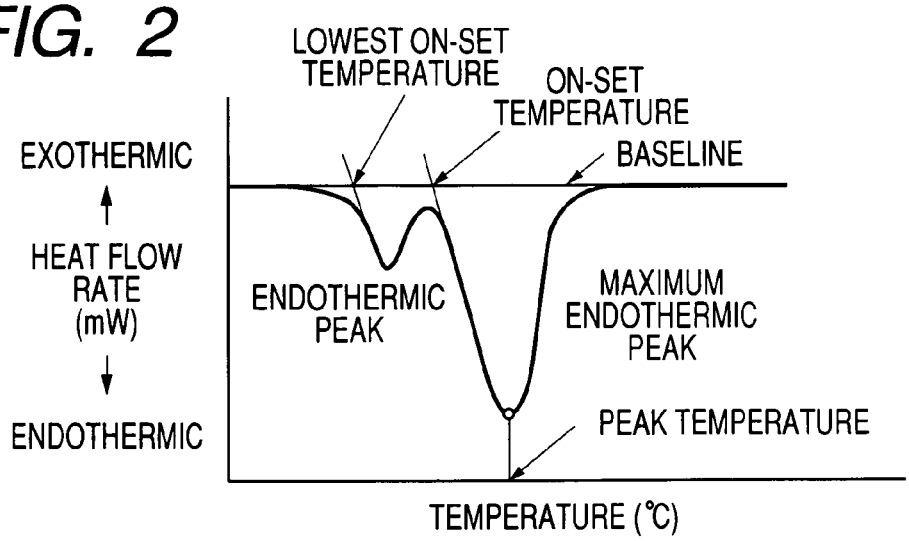
FIG. 2 is a characteristic curve showing the measurement examples of endothermic peak and on-set temperature on a DSC absorbed heat quantity curve of wax.

From the DSC absorbed heat quantity curve as shown in FIG. 2, the peak temperature corresponding to the maximum value of endothermic peaks of the wax, the on-set temperature attributable to the maximum value, and the lowest on-set temperature of the on-set temperatures attributable to plural endothermic peaks if they are observed are obtained. The on-set temperature is defined as the temperature at a point of intersection between a tangential line and the base line by drawing the tangential line along the curve at a point where the differential value of the endothermic peak curve is smallest.

Figure 3:
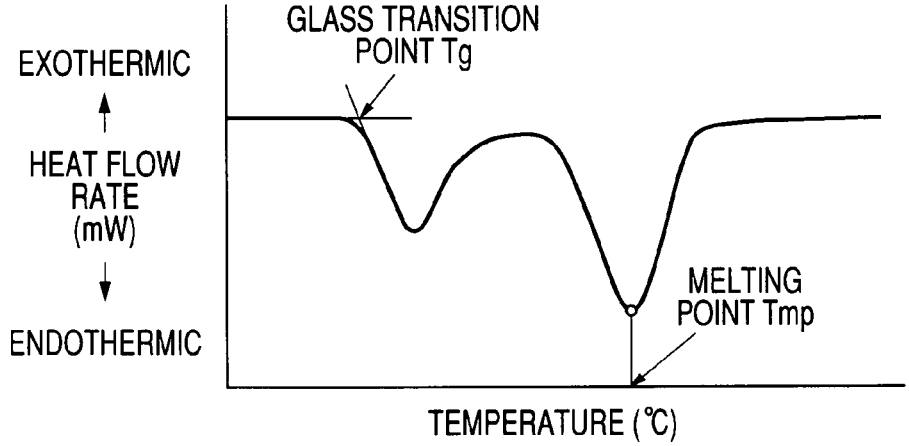
FIG. 3 is a characteristic curve showing the measurement examples of glass transition point and melting point on a DSC absorbed heat quantity curve of toner.

The glass transition point (Tg) of the toner is obtained from a shoulder of the absorbed heat quantity curve attributed to a fixing resin as shown in FIG. 3 by measuring the absorbed heat quantity curve of toner where the heating end temperature of the toner is 160° C. in the DSC measurement. The melting point (Tmp) of toner is obtained from the peak temperature of the maximum endothermic peak in the absorbed heat quantity curve attributable to the wax in the same DSC measurement, as shown in FIG. 3.

Figure 4:
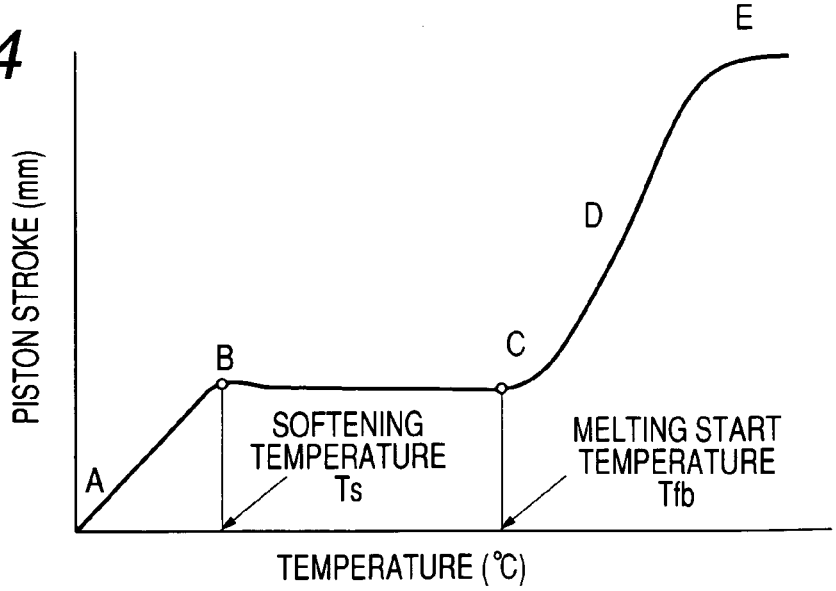
FIG. 4 is a characteristic curve showing a measurement example of melting start temperature by a constant load extrusion capillary rheometer.

In this invention, the melting start temperature (Tfb) of toner is obtained by measuring the melting start temperature in a flow process of the piston stroke as shown in FIG. 4 by a temperature raising method, employing a constant load extruder type capillary rheometer (a flow tester CFT-500C type made by Shimazu Seisakusho). At this time, the measurement conditions of the flow tester are such that the load is 20 kgf/cm$^2$, the die diameter is 1 mm, the die length is 10 mm, and the temperature rise rate is 6° C./minute.

In FIG. 4, A–B is a softening region, B–C is a stop region, C–D–E is an outflow region, Ts is a softening temperature, and Tfb is a melting starting temperature.

In the toner of the invention, an addition amount of hydrocarbon wax is desirably added to the fixing resin by 0.5 to 20 wt % in the total amount of wax. Below 0.5 wt %, there is less effect for improving the fixing performance of toner, while beyond 20 wt %, the durability of toner is reduced, and a high temperature off-set is likely to occur. Other waxes may be employed, but it is required to take care not to impair the performance of hydrocarbon wax of the invention.

Vinyl copolymer used for the fixing resin of the invention contains, as its constituent unit, styrene monomer and/or (metha) acrylate monomer, and may contain other vinyl monomers.

In addition to styrene, specific examples of styrene monomer may include o-methylstyrene, m-methylstyrene, p-methylstyrene, α-methylstyrene, p-ethylstyrene, 2,4-dimethylstyrene, p-n-butylstyrene, p-ter-butylstyrene, p-n-hexylstyrene, p-n-octylstyrene, p-n-dodecylstyrene, p-methoxystyrene, p-phenylstyrene, p-chrolstyrene, and 3,4-dichlorstyrene.

Specific examples of acrylate or methacrylate monomer may include acrylic acid or methacrylic acid alkyl esters, such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethylmethacrylate, propylmethacrylate, n-butyl methacrylate, isobutyl methacrylate, n-octyl methacrylate, dodecyl methacrylate, 2-ethylhexyl methacrylate, stearyl methacrylate, 2-chrolethyl acrylate, phenyl acrylate, α-chrolmethyl acrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate, methacryloxyethylphosphate, in which ethyl acrylate, propyl acrylate, butyl acrylate, methyl methacrylate, ethyl methacrylate, propyl methacrylate, and butyl methacrylate are particularly preferable.

Other vinyl monomers may include acrylic acids and/or α- or β-alkyl derivatives such as acrylic acid, methacrylic acid, α-ethyl acrylic acid, and crotonic acid, unsaturated dicarboxylic acids, monoester derivatives and diester derivatives such as fumaric acid, maleic acid, citraconic acid, and itaconic acid, monoacryloyloxyethyl succinate, monomethacryloylpxyethyl succinate, acrylonitrile, methacrylonitrile, and acrylamide.

The fixing resin is directly able to employ the vinyl copolymer, but may contain vinyl copolymer having the wax uniformly dispersed, at least as its constituent, by performing coexistent polymerization for making the hydrocarbon wax of the invention coexistent in apart or all of the synthesis process, employing the vinyl monomer.

Vinyl copolymer may be cross linked in part by a cross linking agent, which is mainly a monomer having a double bond capable of two or more polymerizations, such as divinyl benzene, divinyl naphthalene, ethylene glycol dimethacrylate, 1,3-butandiol dimethacrylate, divinyl aniline, divinyl ether, divinyl sulfide, and divinyl sulfone.

For the toner of the invention, a charging control agent maybe blended (internal addition) or mixed (external addition) into toner particles to control the charging amount of the toner to a desired value.

The positive charging control agents of the toner may include nigrosine and its denaturated substance of fatty acid, tributhylbenzilammonium-1-hydroxy-4-naphthol sulfonic acid, quaternary ammonium salt such as tetrabuthyl ammonium tetrafluoroborate, onium salts such as phosphonium salt as their analogues and their lake pigments, triphenylmethane dye and their lake pigments, metal salts of higher fatty acid, diorgano tin oxide such as dibutyl tin oxide, dioctyl tin oxide, and dicyclohexyl tin oxide, diorgano tin borates such as dibutyl tin borate, dioctyl tin borate, and dicyclohexyl tin borate, and a combination of two or more kinds thereof. Among others, charging control agents such as nigrosines, quaternary ammonium salts, and triphenyl methane dye are particularly suitably used.

The negative charging control agents of the toner may include organometallic complex and chelate compound, which are effective, acetylacetone metallic complex, and aromatic hydroxy carboxylic acid and aromatic dicarboxylic acid metallic complexes. Besides, there are aromatic hydroxycarboxylic acid, aromatic mono- and polycarboxylic acid, and its metal salts, anhydride, esters, and phenol derivatives such as bisphenol.

When these charging control agents are internally added to a toner, the amount of charging control agent maybe preferably 0.1 to 10 wt % in a fixing resin.

In a toner of the invention, it is desirable to externally add silica powder to enhance the developing property, fluidity, charging stability, and durability.

A silica powder in which the specific surface area with nitrogen adsorption measured by the BET method is 15 m$^2$/g or more is preferably, and externally added in a range from 0.01 to 5 wt % to the toner. A silica powder is made hydrophobic or charged by various treatment agents such as organic silicon compounds, as needed.

Further, other additives to a toner may include, for example, lubricant powders such as polytetrafluoroethylene resin powder, zinc stearate powder, and polyvinylidene fluoride powder. Among others, polyvinylidene fluoride powder is preferable. Or there are polishing agents such as caesium oxide powder, silicone carbide powder, and strontium titanate powder, in which among others, strontium titanate powder is preferable. Or there are fluidity adding agents such as titanium oxide powder and aluminum oxide powder, which preferably have hydrophobic property. Anticoagulation additives, conductivity adding agents such as carbon black powder, zinc oxide powder, antimony oxide powder and tin oxide powder, or white particles and black particles of reverse polarity, maybe employed in small quantity as developing property enhancing agents.

A toner of the invention is mixed with a carrier, when employed as a two-component developer. In this case, a mixture ratio of the toner and the carrier is preferably 1 to 30 wt % as the toner concentration.

In this invention, known carriers are usable, including, for example, iron powder, ferrite, magnetite, glass beads, and those coated with fluororesin, polyester resin, vinyl resin or silicone resin on the surface.

The toner of the invention is usually employed as a two-component developer composed of a toner and a carrier, but may be further employed as a one-component developer by containing a magnetic material in a toner. In this case, the magnetic material may also serve as a coloring agent. In this invention, the magnetic materials contained in the magnetic toner may include magnetite, hematite, ferrite iron oxide, metals such as iron, cobalt and nickel, alloys of those metals with aluminum, cobalt, copper, lead, magnesium, tin, zinc, antimony, calcium, manganese, selenium, titanium, tungsten, and vanadium, and the mixtures thereof.

These magnetic substances have an average particle size of 2 μm or less, preferably from 0.1 to 0.5 μm. The amount contained in a toner should be 20 to 70 wt % in a fixing resin.

A coloring agent for the toner of the invention may be any appropriate pigment or dye. The coloring agents of the toner may include pigments such as carbon black, aniline black, acetylene black, naphthol yellow, Hansa yellow, Rhodamine lake, Alizarin lake, red iron oxide, phthalocyanine blue, and indanthrene blue. They are employed in an amount necessary and sufficient to maintain the optical density of fixed image, and preferably added by 0.2 to 15 wt % in a resin.

Moreover, A dye may be employed for the same purpose, for example, azoic dye, anthraquinone dye, xanthene dye, or methyl dye, and added by 0.2 to 15 wt % in a resin.

To produce an electrostatic image developing toner according to this invention, a fixing resin, a fixing resin containing a wax and/or wax having a wax of the invention uniformly dispersed by coexistent polymerization, charging control agent, pigment or dye as coloring agent, magnetic powder, and other waxes or additives as needed, are fully mixed by a mixing machine such as a Henshell mixer or a super mixer, and then molten and kneaded using a heat melting kneading machine such as a heating roller, a kneader or an extruder to fully mix the raw materials. After cooling, solidifying, pulverizing, and classifying, a toner having an average particle size of 3 to 10 μm is produced. Moreover, a desired additive may be deposited and mixed on the surface of toner by a mixing machine such as a Henshell mixer, as needed, thereby producing a toner having the additive externally added.

With a toner of the invention, in an electrostatic image recording process of developing an electrostatic image formed on an electrostatic image holding member, using a two-component developer composed of a toner and a carrier, transferring the developed toner image onto a recording medium, cleaning a toner image remaining on the electrostatic image holding member, and fixing the toner image transferred on the recording medium to produce a recorded image, the fixing performance is particularly excellent, the toner is excellent in the heat resistance, durability, preservation stability, and fluidity, the toner concentration is less likely to change due to a shorter developer life caused by a carrier spent with the toner, a shorter photoconductor life caused by a photoconductor filming with the toner, and a lower fluidity of the toner caused under the environment, whereby a stable electrostatic toner image is produced.

For the wax A, weight average molecular weight (Mw)/number average molecular weight (Mn) is more than 1.5, melt viscosity at 140° C. is less than 10 mPa·s, and crystallinity is less than 90%. The weight average molecular weight (Mw)/number average molecular weight (Mn) is preferably in a range of from 1.5 to 10, and more preferably from 1.7 to 6. The melt viscosity is preferably in a range of from 1 to 10 mPa·s, and more preferably from 3 to 9 mPa·s. The crystallinity is preferably in a range of from 70 to 90%, and more preferably from 80 to 90%.

For the wax B, weight average molecular weight (Mw)/number average molecular weight (Mn) is 1.5 or less, melt viscosity at 140° C. is less than 10 mPa·s, and crystallinity is 90% or more. The weight average molecular weight (Mw)/number average molecular weight (Mn) is preferably in a range of from 0.5 to 1.5, and more preferably from 1 to 1.4. The melt viscosity is preferably in a range of from 1 to 10 mPa·s, and more preferably from 4 to 9 mPa·s. The crystallinity is preferably in a range of from 90 to 100%, and more preferably from 90 to 95%.

EXAMPLES

Example 1

A toner material, which was a blend of styrene acrylic copolymer resin 85 wt % composed of styrene 90 weight parts and n-butyl acrylate 10 weight parts, and having a weight average molecular weight of about 230,000, chromium containing metal dye (made by Orient Chemical Industries, trade name: Bontron S-34) 1 wt %, carbon black (made by Mitsubishi Chemical, trade name: MA-100) 10 wt %, hydrocarbon wax B-1 2.8 wt %, hydrocarbon wax A-1 1.2 wt %, was preliminarily mixed by a super mixer, thermally molten and kneaded by a two-shaft kneading machine, milled by a jet mill, and classified by an air classifier, thereby producing particles having an average particle size of about 9 μm.

Further, hydrophobic silica (made by Japan Aerogyl, trade name: Aerogyl R972) 0.8 wt % is added to the particles, agitated by a Henshell mixer, and deposited on the surface of the particles to produce a toner of the invention.

The hydrocarbon wax B-1 is polyethylene wax, in which weight average molecular weight (Mw)/number average molecular weight (Mn) is 1.20, melt viscosity at 140° C. is 6.0 mPa·s, and crystallinity is 93%. The hydrocarbon wax A-1 is a mixture of paraffin wax and polyolefine wax, in which weight average molecular weight (Mw)/number average molecular weight (Mn) is 5.75, melt viscosity at 140° C. is 4.3 mPa·s, and crystallinity is 81%.

A wax mixture (B-1/A-1=7/3 weight ratio) is a wax without branching, in which branching carbon is not observed measured by 13C-NMR, and in DSC curve, maximum endothermic peak of endothermic peaks at the temperature up is 61° C., and on-set temperature attributable to the maximum endothermic peak is 53° C. Also, other endothermic peaks are 48° C. and 89° C., and lowest on-set temperature of on-set temperatures attributable to them is 37° C.

Melting start temperature (Tfb) of the toner was 101° C., and in DSC curve of the toner, melting point (Tmp) corresponding to the maximum endothermic peak attributable to the wax in an absorbed heat quantity curve at temperature up was 91° C., and glass transition point of the toner was 51° C. Also, decrease ratio of fluidity for the toner was −1.6% when preservation temperature of the toner changed from 45° C. to 50° C.

The toner was applied to a laser beam printer of electrophotography method using OPC as a photoconductor, and the image formation was made at a printing speed of 60 sheets per minute (printing process speed of 26.7 cm/sec) where OPC charging potential was −650V, residual potential was −50V, developing bias potential was −400V, and developing portion contrast potential was 350V.

A developing machine used, as a carrier, a magnetite carrier (electrical resistance $4.1\times10^{8}\Omega\cdot$cm) having a weight average particle size of 100 μm that was coated with a conductive agent contained silicone resin, a developer was prepared at a toner concentration of 3.0 wt %, a developing gap (distance between photoconductor and developing roll sleeve) was set to 0.8 mm by magnetic brush developing method, a photoconductor and a developing roll were moved in same direction, a peripheral speed ratio of both (developing roll/photoconductor) was about 3, whereby a image was produced in reversal.

A fixing machine had a heating roller in which an aluminum core metal was thinly covered with a tube made of a fluororesin (tetrafluoroethylene to perfluoroalkylvinyleter copolymer: PFA) (thickness 40 μm), with a heater lamp installed in the center, and a backup roller in which a silicon rubber layer (thickness 7 mm) having a rubber hardness of about 30 degrees was laid around the aluminum core metal, with the outermost layer covered with a PFA tube.

A fixing condition were such that process speed was 26.7 cm/sec, outer diameter of the heating roller and the backup roller was 60 mm, pressing load was 50 kgf, width of a contact region (nip) between both was about 7 mm, and the control temperature of the heating roller was 175° C. A cleaner of Nomex paper winding type impregnated a silicone oil was installed on the heating roller.

The toner was placed in a metallic dish, and left away at 50° C. for 24 hours in a desiccator where humidity was controlled at 65% RH by a humidity conditioning agent, whereby the degree of toner coagulation was evaluated visually. As a result, the toner caused no apparent coagulation, and had excellent preservation stability.

Also, continuous printing was performed with the laser beam printer, whereby excellent fixing performance was attained. After the continuous printing of 300,000 pages, a stable image was produced without shortening developer life by a carrier spent with the toner, or photoconductor life by a photoconductor filming with the toner. Moreover, even if the continuous printing at high temperature and high humidity (32° C., 80% RH) was performed, there was no abnormal change in the toner concentration, whereby a stable image was obtained.

Example 2

A resin having maximum value of about 400,000 in a molecular weight distribution was produced by polymerizing styrene 70 weight parts, methyl methacrylate 10 weight parts, and n-butyl acrylate 20 weight parts. A mixture of this resin 200 g and the wax mixture of example 1 (hydrocarbon wax B-1/hydrocarbon wax A-1=7/3 weight ratio) was put into a separable flask of 3 litters to dissolve in one litter of xylene. After replacing gas phase with nitrogen gas, whereby this system was heated to a boiling point (135 to 145° C.) of xylene A mixture of styrene 440 g, n-butyl acrylate 65 g and t-butylperoxy2-ethylhexyanoate as a polymerization initiator 30 g was dissolved and dripped for 2.5 hours while being agitated in a state where a reflux of xylene is caused, making a solution polymerization to polymerize polymer components of low molecular weight under existence of high molecular weight polymer and hydrocarbon wax. After end of the dripping, the mixture was ripened for one hour, while being agitated, at the temperature where xylene boils. Thereafter, xylene was desolvated by gradually increasing temperature of the system to 180° C., under reduced pressure, thereby producing resin in which peak in molecular weight distribution on the low molecular weight was about 4500. In this resin, content of the hydrocarbon wax is about 6 wt %.

Then, a toner material, which was a blend of the hydrocarbon wax contained styrene-acrylic polymer resin 89 wt %, chromium containing metal dye (made by Orient Chemical Industries, trade name: Bontron S-34) 1 wt %, and carbon black (made by Mitsubishi Chemical, trade name: MA-100) 10 wt %, was preliminarily mixed by a super mixer, thermally molten and kneaded by a two-shaft kneading machine, milled by a jet mill, and classified by an air classifier, thereby producing toner particles having an average particle size of about 9 μm.

Further, hydrophobic silica (made by Japan Aerogyl, trade name: Aerogyl R972) 0.8 wt % was added to the particles, agitated by a Henshell mixer, and deposited on the surface of particles to produce a toner of the invention.

Melting start temperature (Tfb) of the toner was 100° C., and in DSC of wax components of the toner, melting point (Tmp) corresponding to maximum value in an absorbed heat quantity curve was 90° C., and glass transition point of the toner was 51° C. Also, the decrease ratio of fluidity for the toner was −1.0% when preservation temperature of the toner changed from 45° C. to 50° C.

As a result of evaluating the toner in the same way as in the example 1, excellent results were also obtained as in the example 1.

Referring to FIG. 1, constitution of the laser beam printer will be described. In FIG. 1, reference numeral 1 denotes a basic apparatus main body having a printing portion 3 that can be drawn from an apparatus frame 2. Reference numeral 4 denotes a photoconductor on which a toner image is recorded through the well-known electro photographic process, the photoconductor being supported by a support shaft to be rotatable at a constant speed in a direction of the arrow a.

A charger 5 is opposed to a surface of the photographic drum 4, and uniformly charges the surface of the photographic drum 4 that is passed to be opposed to the charger 5. A laser beam 6 exposing the uniformly charged surface of the photographic drum forms an electrostatic latent image on the surface of the photographic drum 4 in accordance with a print information signal supplied from an information processing apparatus.

A developing unit 7 is opposed to the surface of the photographic drum 4 on which the electrostatic latent image is formed. This developing unit 7 has a development function of forming the toner image by depositing the toner onto the surface of the photographic drum 4 due to an electrostatic force of the electrostatic latent image.

A cassette 8 accommodates a stack of sheets of recording medium (paper) 9 on which the image is printed by transferring and fixing the toner image. A paper feed roller mechanism 10 constituting a part of recording medium conveying means picks up paper 9 from the cassette 8 and feeds it to the photographic drum 4.

The paper 9 fed from the paper feed roller mechanism 10 is contacted with the surface of the photographic drum 4 to transfer the toner image onto the surface. A transfer unit 11 supplies electric charges of opposite polarity to the toner image onto the back face of the paper 9 contacted with the surface of the photographic drum 4 to generate an electrostatic force to transfer the toner image formed on the surface of the photographic drum 4 to the paper 9.

A conveyer belt 12 constituting another part of paper conveying means conveys paper 9 onto which the toner image is transferred to a contact type thermally fixing unit 13 as a fixing mean. A pair of fixing rollers 14 consisting of a heat roller 14*a* and a backup roller 14*b* that are contacted with each other under pressure fix the toner image on the surface of the paper 9 by heating and pressurizing the paper 9.

The paper 9 fed from the fixing unit 13 is exhausted to an exhausting portion 16 or 17 depending on a position of a paper conveying passage switching member 15, or the paper 9 fed from the fixing unit 13 is conveyed halfway to the exhausting portion 17 and conveyed to a perfect printing paper feeding passage 20 at a predetermined timing to supply the printing paper printed on one face to the printing portion 3 again to print the toner image on the back face of paper.

In FIG. 1, reference numeral 18 denotes a cleaner unit for cleaning the toner or foreign matters such as paper powder remaining on the surface of the photographic drum 4 after passing through the transfer unit 11 from the surface of the photographic drum 4. Reference number 19 denotes a toner refill unit for refilling a toner to the developing unit 7, as needed.

In FIG. 1, a laser beam printer mounting the developing unit having one developing roller is illustrated. However, in the laser beam printer, the developing unit may have two or more developing rollers or may take the center field system in which a developing roller rotating in the same direction as the photographic drum and a developing roller rotating the opposite direction to the photographic drum are provided.

What is claimed is:

1. An electrostatic charge image developing toner comprising:

a fixing resin; and a wax mixed with the fixing resin, wherein the wax comprises a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C. to 40° C., in a DSC curve measured by a differential scanning calorimeter for the wax.

2. The electrostatic charge image developing toner according to claim 1, wherein the wax comprises a hydrocarbon wax containing no branching carbon measured by 13C-NMR.

3. The electrostatic charge image developing toner according to claim 1, wherein the wax comprises:

a first wax; and a second wax, wherein the first wax comprises a wax in which a weight average molecular weight (Mw)/number average molecular weight (Mn) is more than 1.5, a melt viscosity at 140° C. is less than 10 mPa·s, and a crystallinity is less than 90%, and wherein the second wax comprises is a wax in which a weight average molecular weight (Mw)/number average molecular weight (Mn) is 1.5 or less, a melt viscosity at 140° C. is less than 10 mPa·s, and a crystallinity is 90% or more.

4. The electrostatic charge image developing toner according to claim 3, wherein the first wax comprises a wax in which the weight average molecular weight (Mw)/number average molecular weight (Mn) is in a range of from 1.5 to 10, the melt viscosity at 140° C. is equal to or larger than 1 mPa·s, and the crystallinity is in a range of from 70 to 90%, and wherein the second wax comprises a wax in which the weight average molecular weight (Mw)/number average molecular weight (Mn) is in a range of from 0.5 to 1.5, the melt viscosity at 140° C. is equal to or lager than 1 mPa·s, and the crystallinity is in a range of from 90 to 100%.

5. The electrostatic charge image developing toner according to claim 3, wherein the wax mainly includes the second wax.

6. The electrostatic charge image developing toner according to claim 1, wherein the fixing resin comprises a vinyl copolymer, and comprises a copolymer polymerized under existence of the wax.

7. The electrostatic charge image developing toner according to claim 1, wherein a melting start temperature (Tfb) of the toner has a relation Tmp<Tfb<110° C. for melting point (Tmp) corresponding to the maximum endothermic peak attributed to the wax in an absorbed heat quantity curve when the temperature is increasing in a DSC curve of the toner measured by a differential scanning calorimeter, and glass transition point (Tg) of the toner is above 50° C.

8. The electrostatic charge image developing toner according to claim 1, wherein when a storage temperature of the toner is changed from 45° C. to 50° C., a decrease ratio in fluidity of the toner is less than 7%.

9. The electrostatic charge image developing toner according to claim 1, wherein a total amount of the wax is in a range of from 0.5 to 20 wt % for the fixing resin.

10. The electrostatic charge image developing toner according to claim 1, wherein said wax comprises:

a first wax; and a second wax, wherein a ratio of said second wax to said first wax in said wax is 7/3.

11. A developer comprising:

an electrostatic charge image developing toner; and a magnet carrier mixed with the electrostatic charge image developing toner, wherein the electrostatic charge image developing toner comprises:

a fixing resin; and a wax mixed with the fixing resin, and wherein a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C., to 40° C., in a DSC curve measured by a differential scanning calorimeter for the wax.

12. The developer according to claim 11, wherein an average particle size of the toner is in a range of from 3 to 10 μm, and an average particle size of the magnetic carrier is in a range of from 30 to 100 μm.

13. An image forming apparatus comprising:

a photoconductor;

a charger for uniformly charging a surface of the photoconductor;

an optical system for forming an electrostatic latent image by exposing the charged surface of the photoconductor;

a developing unit for developing the electrostatic latent image with a toner;

a transfer unit for transferring a toner image onto a recording medium; and a fixing unit for fixing the toner image on a recording medium, wherein the toner comprises:

a fixing resin; and a wax mixed with the fixing resin, and wherein a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C. to 40° C., in a DSC curve measured by a differential scanning calorimeter for the wax.

14. The image forming apparatus according to claim 13, wherein the fixing unit comprises a contact type heating fixing unit.

15. The image forming apparatus according to claim 14, wherein the contact type heating fixing unit comprises a heat roller, and wherein a control temperature of the heat roller is in a range of from 150 to 180° C.

16. The image forming apparatus according to claim 13, wherein the image forming apparatus performs high speed printing at 10 pages or more per minute in A4 longitudinal size of the recording medium.

17. An image forming apparatus comprising:

a photoconductor;

a charger for uniformly charging a surface of the photoconductor;

an optical system for forming an electrostatic latent image by exposing the charged surface of the photoconductor;

a developing unit for developing the electrostatic latent image with a developer;

a transfer unit for transferring a toner image onto a recording medium; and a fixing unit for fixing the toner image on the recording medium, wherein the developer comprises:

an electrostatic charge image developing toner; and a magnet carrier mixed with the electrostatic charge image developing toner, wherein the electrostatic charge image developing toner comprises:

a fixing resin; and a wax mixed with the fixing resin, and wherein a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C. to 40° C., in a DSC curve measured by a differential scanning calorimeter for the wax.

18. An image forming method comprising:

uniformly charging a surface of a photoconductor;

forming an electrostatic latent image by exposing the charged surface of the photoconductor;

developing the electrostatic latent image with a toner;

transferring a toner image onto a recording medium; and fixing the toner image on the recording medium, wherein the toner comprises:

a fixing resin; and a wax mixed with the fixing resin, and wherein a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C. to 40° C., in a DSC curve measured by a differential scanning calorimeter for the wax.

19. An image forming method comprising:

uniformly charging a surface of a photoconductor;

forming an electrostatic latent image by exposing the charged surface of the photoconductor;

developing the electrostatic latent image with a developer;

transferring a toner image onto a recording medium; and fixing the toner image on the recording medium, wherein the developer comprising:

an electrostatic charge image developing toner; and a magnet carrier mixed with the electrostatic charge image developing toner, and wherein the electrostatic charge image developing toner comprises:

a fixing resin; and a wax mixed with the fixing resin, and wherein a maximum endothermic peak of endothermic peaks when a temperature is increasing that is less than 70° C., an on-set temperature attributable to the maximum endothermic peak that is above 50° C., and a lowest on-set temperature of on-set temperatures attributable to endothermic peaks except the maximum endothermic peak that is in a range of from 30° C. to 40° C., in a DSC curve measured by a differential scanning calorimeter for the wax.

* * * * *